US007703628B2

(12) United States Patent
Cadiente et al.

(10) Patent No.: US 7,703,628 B2
(45) Date of Patent: Apr. 27, 2010

(54) PRODUCE PACKAGING SYSTEM ENABLING IMPROVED DRAINAGE FOR HYDROCOOLING

(75) Inventors: Anthony Cadiente, Salinas, CA (US); Mark Sambrailo, Watsonville, CA (US)

(73) Assignee: Sambrailo Packaging, Inc., Watsonville, CA (US)

( * ) Notice: Subject to any disclaimer, the term of this patent is extended or adjusted under 35 U.S.C. 154(b) by 792 days.

(21) Appl. No.: 11/521,233

(22) Filed: Sep. 13, 2006

(65) Prior Publication Data

US 2007/0009632 A1 Jan. 11, 2007

Related U.S. Application Data

(63) Continuation-in-part of application No. 10/017,893, filed on Dec. 12, 2001, now Pat. No. 7,100,788, which is a continuation-in-part of application No. 09/590,631, filed on Jun. 8, 2000, now abandoned, which is a continuation of application No. 09/060,453, filed on Apr. 14, 1998, now Pat. No. 6,074,676, which is a continuation of application No. 08/591,000, filed on Jan. 24, 1996, now Pat. No. 5,738,890, application No. 11/521,233, which is a continuation-in-part of application No. 11/251,352, filed on Oct. 13, 2005, and a continuation-in-part of application No. 11/139,275, filed on May 27, 2005, now abandoned.

(60) Provisional application No. 60/818,740, filed on Jul. 5, 2006.

(51) Int. Cl.
*B65D 51/16* (2006.01)

(52) U.S. Cl. ..... 220/366.1; 220/676; 220/913

(58) Field of Classification Search ..... 220/4.21–4.23, 220/366.1, 676, 913
See application file for complete search history.

(56) References Cited

U.S. PATENT DOCUMENTS

| | | | |
|---|---|---|---|
| 1,800,346 | A | 4/1931 | Slagel |
| 1,953,765 | A | 4/1934 | McCluney |
| 2,088,107 | A | 7/1937 | Hassenfeld |
| 2,652,335 | A | 9/1953 | Conti |
| 2,660,529 | A | 11/1953 | Bloom |
| 2,684,907 | A | 7/1954 | Brunsing |

(Continued)

FOREIGN PATENT DOCUMENTS

| | | |
|---|---|---|
| AU | 2003234951 | 6/1994 |

(Continued)

OTHER PUBLICATIONS

International Search Report in Corresponding PCT application PCT/US07/70543, mailed Jun. 10, 2008.

(Continued)

*Primary Examiner*—Anthony Stashick
*Assistant Examiner*—Harry A Grosso
(74) *Attorney, Agent, or Firm*—Beyer Law Group LLP

(57) ABSTRACT

A produce packaging system incorporates a container having ample top ventilation enabling efficient ingress of cooling water into container to cool produce contained inside. The container also having a sloped bottom for draining water toward a bottom vent and out of the container during hydrocooling. The system also includes a cooling box configured for holding the containers in an upright orientation enabling inflow of cooling water into the containers and out of the box.

13 Claims, 8 Drawing Sheets

U.S. PATENT DOCUMENTS 2,739,734 A 3/1956 Pugh
2,936,094 A 5/1960 Smith
3,037,658 A 6/1962 Schray et al.
3,042,247 A 7/1962 Bonnet
3,055,572 A 9/1962 Crane
3,080,087 A 3/1963 Cloyd
3,148,822 A 9/1964 Yochum
3,253,762 A 5/1966 Gaunt
3,567,063 A 3/1971 Kovach
3,567,107 A * 3/1971 Artz ..... 206/521.1
3,613,938 A 10/1971 Westcott
3,651,977 A 3/1972 Morgan
3,741,815 A 6/1973 Peterson
3,747,802 A 7/1973 Uroshevich
3,794,090 A 2/1974 Commisso
3,837,526 A * 9/1974 Medendorp ..... 220/782
3,912,118 A 10/1975 Bird
3,933,296 A 1/1976 Ruskin et al.
3,937,389 A 2/1976 Wind
3,979,007 A 9/1976 Thornbloom
4,143,695 A 3/1979 Hoehn
4,161,261 A 7/1979 Frater
4,206,845 A 6/1980 Christian
D256,097 S 7/1980 Amberg
4,390,113 A 6/1983 Bird
4,478,344 A 10/1984 Rehrig
D276,216 S 11/1984 Michaud
4,529,088 A 7/1985 Quong
4,570,818 A 2/1986 Borst et al.
4,576,330 A * 3/1986 Schepp ..... 220/315
4,597,503 A 7/1986 Lates
4,618,069 A 10/1986 Quong
4,664,281 A 5/1987 Falk et al.
4,704,510 A 11/1987 Matsui
4,741,452 A 5/1988 Holzkopf
4,767,008 A 8/1988 Warnecke et al.
4,771,934 A 9/1988 Kalmanides
4,819,822 A 4/1989 Box
4,844,263 A 7/1989 Hadtke
4,859,822 A 8/1989 Ragusa et al.
4,883,195 A 11/1989 Ott et al.
4,974,738 A 12/1990 Kidd et al.
D315,100 S 3/1991 Sheehan
5,046,659 A * 9/1991 Warburton ..... 220/4.22
5,069,344 A 12/1991 Dehart
5,076,459 A 12/1991 Dehart
5,118,173 A 6/1992 Proctor et al.
5,191,994 A 3/1993 Stauble
D339,744 S 9/1993 Seppala
5,265,749 A 11/1993 Zutler
D343,576 S 1/1994 Krupa
D345,894 S 4/1994 Krupa
D348,608 S 7/1994 Wyslotsky
5,325,602 A 7/1994 Nainis et al.
5,339,973 A 8/1994 Edwards et al.
D354,436 S 1/1995 Krupa
5,423,453 A 6/1995 Fritz
5,435,449 A 7/1995 Gelardi
D361,035 S 8/1995 Krupa
D361,036 S 8/1995 Krupa
D363,022 S 10/1995 Krupa et al.
5,456,379 A 10/1995 Krupa et al.
D363,879 S 11/1995 Krupa et al.
5,465,901 A 11/1995 Paine
5,497,894 A 3/1996 Krupa et al.
5,515,993 A 5/1996 McManus
D376,314 S 12/1996 Krupa
D378,192 S 2/1997 Krupa et al.
D379,300 S 5/1997 Krupa et al.
D380,381 S 7/1997 Krupa et al.
D382,795 S 8/1997 Abayhan et al.
D385,784 S 11/1997 Krupa et al.
D393,204 S 4/1998 Goins et al.
5,738,890 A 4/1998 Cadiente et al.
5,803,303 A 9/1998 Timm et al.
D409,485 S 5/1999 Christy, Jr.
5,947,321 A 9/1999 Vadney
5,964,350 A 10/1999 Lamarche et al.
6,007,854 A 12/1999 Cadiente et al.
6,074,676 A 6/2000 Cadiente et al.
6,257,401 B1 7/2001 Mangla et al.
D448,288 S 9/2001 Zettle et al.
6,540,078 B1 4/2003 Homent et al.
6,644,494 B2 11/2003 Hayes et al.
6,851,551 B2 2/2005 Lemaire
6,962,263 B2 11/2005 Cadiente et al.
7,100,788 B2 * 9/2006 Cadiente et al. ..... 220/366.1
7,413,094 B2 * 8/2008 Cadiente et al. ..... 220/23.88
7,472,799 B2 * 1/2009 Cadiente et al. ..... 220/366.1
2003/0077363 A1 4/2003 Cadiente et al.
2004/0173669 A1 9/2004 Kent
2004/0195115 A1 10/2004 Colombo
2005/0218150 A1 10/2005 Cadiente
2005/0242098 A1 11/2005 Cadiente
2006/0027578 A1 2/2006 Cadiente

FOREIGN PATENT DOCUMENTS

DE 857860 12/1952
GB 1074164 6/1967
GB 2160510 12/1985
GB 2200340 8/1988
GB 2341173 3/2000
WO WO 00/20286 4/2000

OTHER PUBLICATIONS

Written Opinion in Corresponding PCT application PCT/US07/70543, mailed Jun. 10, 2008.
Office Action from related Chinese application 02822365.9, dated Dec. 2, 2005.
Search Report from related European application 02757619.8, dated Jun. 23, 2005.
International Search Report from related PCT application PCT/US03/34030 dated Apr. 20, 2004.
International Search Report in related PCT Application PCT/U505/37782 dated Aug. 8, 2007.
Written Opinion in related PCT Application PCT/US05/37782 dated Aug. 8, 2007.
Internet web page, "Double Closure Clamshell", www.i-caenterprises.com, dated Oct. 25, 2005, 1 page.
International Search Report in related PCT application PCT/US02/28338 dated Mar. 12, 2003.

* cited by examiner

PRODUCE PACKAGING SYSTEM ENABLING IMPROVED DRAINAGE FOR HYDROCOOLING

CROSS-REFERENCE TO RELATED PATENT APPLICATIONS

This application is a continuation-in-part of application Ser. No. 10/017,893, filed Dec. 12, 2001 now U.S. Pat. No. 7,100,788, which is a continuation-in-part of application Ser. No. 09/590,631, filed Jun. 8, 2000 now abandoned, which is a continuation of application Ser. No. 09/060,453 filed Apr. 14, 1998 and allowed as U.S. Pat. No. 6,074,676, issued on Jun. 13, 2000, which is a continuation of application Ser. No. 08/591,000, filed Jan. 24, 1996 and issued as U.S. Pat. No. 5,738,890 on Apr. 14, 1998, all of which are hereby incorporated by reference for all purposes. Priority of U.S. provisional application No. 60/818,740 filed on Jul. 5, 2006 is claimed under 35 U.S.C. § 119(e).

This application is also a continuation-in-part of application Ser. No. 11/139,275, filed May 27, 2005 now abandoned (entitled "Produce Packaging Container With Dual Hinged Resealable Tops"), and also a continuation-in-part of co-pending application Ser. No. 11/251,352 filed Oct. 13, 2005 (entitled: "Produce Packaging Container With Dual Hinged Resealable Tops")

TECHNICAL FIELD

The present invention relates to apparatus and methods for the improved packing, cooling, storage, and shipping of produce. More particularly, the present invention teaches methods and apparatus for implementing improved hydrocooling. In particular, aspects of the invention teach novel produce containers that are packaged together in a hydrocooling box and subjected to hydrocooling. The produce containers are configured with a well vented top enabling efficient coolant access to the produce contained inside while also configured to enable efficient drainage of the fluid out of the bottom of the container without excess coolant pooling in the container. Additionally, the present invention enables cooling air to flow through and underneath the produce containers in more than one direction in order to facilitate improved cooling.

BACKGROUND

Many produce products are harvested and packed in the field into containers, which are currently shipped in bulk to stores where they are unpackaged and sold to consumers. Many of these produce items require substantial post-harvest cooling in order to enable shipping over long distances and to prolong shelf life. Many such produce products are advantageously subjected to hydrocooling to effect rapid efficient cooling before they are shipped out in refrigerated or insulated shipping containers. Among the many produce products that benefit from such processing include, but are not limited to, asparagus, beans, peas, asparagus, zucchini, cucumbers, radishes, carrots, celery, beets, sweet corn, apples, cantaloupes, peaches, and various greens and other produce products. A wide listing of such products can be found for, example, in *Extension Service publication AG*-414-1, Introduction to Postharvest Cooling and Handling Methods, which also addresses many of the concerns associated with hydrocooling.

Most fresh fruits and vegetables require thorough cooling immediately after harvest in order to deliver the highest quality product to the consumer. Proper cooling delays the inevitable quality decline of produce and lengthens its shelf life. Most wholesale buyers now require that fresh produce items be properly and thoroughly cooled before they are shipped to market.

When warm produce is cooled directly by chilled water, the process is known as hydrocooling. Hydrocooling is an especially fast and effective way to cool produce. Modern technologies have made hydrocooling a convenient and attractive method of postharvest cooling on a large scale.

As stated previously, many types of produce respond well to hydrocooling. This is particularly true with respect to produce items having a large volume relative to their surface area that would otherwise be difficult to cool. Such products are now quickly and effectively hydrocooled. Additionally, unlike air cooling, no water is removed from the produce during cooling. In fact, slightly wilted produce may sometimes be revived by hydrocooling. Hydrocooling is fast and can easily accommodate large amounts of produce.

In general, a hydrocooler produces chilled water and then moves this water into contact with the produce. This can be accomplished using a number of methods. However, most commonly, chilled water is pumped into contact with the produce. The water warmed by the produce is commonly gathered and recirculated through a cooling element where it is again showered onto the produce. Vapor-compression refrigeration systems similar to an air conditioners or refrigerators are commonly used to cool the water. Alternatively, some hydrocoolers do not use a refrigeration system. Instead, crushed or chunk ice is used to cool the water. Typically, large blocks of ice are crushed and added as needed to a water reservoir attached to the hydrocooler. In either case the basic idea is the same, the produce is brought into contact with cooling water to effectuate rapid cooling of the produce.

The design of produce packaging and the stacking arrangement is critical to the heat transfer process in hydrocooling. A variety of known produce packages are now used in hydrocooling. These packages include wire-bound wooden crates, waxed fiberboard cartons, mesh poly bags, and bulk bins. Palletized packages can be hydrocooled if they are carefully stacked to allow water to enter the packages. Most if not all present hydrocooling containers are large containers constructed to facilitate maximum water flow. Heretofore, small consumer sized containers are not used because they generally exhibit poor water flow characteristics. This is critical because, if the water flows around and not through the containers, little contact is made with the produce and consequently little cooling occurs. Additionally, such packages must be robust enough to protect delicate produce contained within the package (e.g., asparagus, grapes, and the like). This is why mesh poly bags that are sometimes used have problems. So, in the present art, produce is commonly placed, in bulk, in large waxed cardboard cartons that are subjected to hydrocooling processes. Typically, large wire-bound cartons and crates large volumes of open space are used for hydrocooling because they allow for sufficient entry of water. For example, 20-bushel bulk bins are commonly used because the cool water can easily percolate down through the product facilitating effective cooling.

Although hydrocooling is an excellent cooling method, it does have certain limitations, for example, hydrocooling wets the produce. Such wet produce provides excellent sites for postharvest diseases. Additionally, produce is particularly susceptible to postharvest diseases when it is stressed by too much or too little water, high rates of nitrogen, or mechanical injury (scrapes, bruises, or abrasions). This last factor is particularly at issue in the present art because during unloading and unloading of the bulk produce (for example, when unloaded for display and sale in a store) significant damage can occur to the produce. Commonly, as much as 20% of a produce lot is lost through wastage in this way. Additionally, water pooling at the bottom of present art crates presents some problems. For example, because the hydrocooling water is recirculated, it can spread disease from a few infected items to all the produce hydrocooled thereafter. Commonly, disinfectants such as chlorine are added to the coolant to reduce the incidence of disease. However, this presents its own problems, as chlorine can damage the produce (for example, by surface bleaching, etc.) if it pools around the produce in too high a concentration. Thus, it is important that the water not pool around the produce in too high a quantity.

Additionally, as alluded to above, produce suffers extensively from customer/clerk handling in stores once set out for display. For example, in the case of asparagus, asparagus spears are cut in the field and rubber banded together in batches and then gathered in bulk in wax boxes for hydrocooling. Once cooled the asparagus is maintained in a refrigerated shipping compartment in the boxes (which do not circulate air particularly well) until it is delivered to its desired destination (typically a retail outlet). The batches are then unloaded and arranged for display. Customers then repeatedly handle and examine the batches resulting in serious amounts of product having to be discarded due to damage. Additionally, with each handling there arises an added risk of transferring pathogens onto the produce. None of this is desirable and a solution to these shortcomings is desirable.

What is clearly needed is an improved hydrocooling and packaging system, which will enable small batches of produce to be individually packaged and protected. Additionally, the system should enable effective hydrocooling of large quantities of produce in large containers while also enabling effective high volume cooling water flow into each of the individual packages enabling effective hydrocooling of the produce contained therein. Additionally, the system should enable effective drainage of the cooling water out each of the individual produce packages as well as the large containers thereby preventing substantial pooling of water beyond what is necessary to prevent the produce from drying out. Moreover, it would be advantageous to provide a cooling system that facilitates efficient airflow through the individual packages of the system in order to maximize air transfer rates. Such systems can result in more effective cooling. To make such an improved system feasible, it must interface with commonly used and preferred materials handling apparatus, for example, the standard forty by forty eight inch pallets in current use in the grocery industry. Moreover, where a different pallet size has been adopted as standard, for instance in another country, what is further needed is a system which can be scaled to effect the advantages hereof in that pallet system.

The baskets of such a system should be capable of being formed in the preferred size or quantity configuration preferred by the end consumer, while simultaneously maximizing their footprint on existing pallet technology. The baskets should be formed to minimize bruising and other damage to the produce packed therein. Furthermore, such a system should provide for the mixing of lots of different types, quantities and sizes of produce on a single pallet without substantial losses of packaging efficiency occasioned by differing types of misaligned trays. Finally, it would be desirable if the system enabled the stacking of one or more layers of filled produce containers.

If possible, the system should be formed utilizing existing equipment and machinery from materials of the same or lesser cost than currently available produce packages.

SUMMARY OF THE INVENTION

In accordance with the principles of the present invention, produce packaging systems are disclosed. Such systems remedy at least some of the problems illustrated above.

Embodiments of the invention include a produce container having a body with a front side, a bottom, a top, a back, and two sides with a lid for covering the front side of the body. A latch is used for securing the lid to said basket body. The bottom is configured to enable fluid to drain out of the basket. The top includes an upper ventilation surface with apertures configured to enable fluid to flow into the container in a manner enabling the fluid to contact substantially all of the contents of the container.

In another implementation the invention involves a produce packaging system. The system includes an open top cooling box with drainage openings in the bottom surface of the box. Also, the system includes produce containers having a body with a back, bottom, top, two sides, and an open front. The container includes a lid for covering the basket body and a latch for securing the lid to the body. The bottom of the container includes a bottom ventilation slot and a bottom surface angled toward the bottom ventilation slot to enable fluid to drain toward the bottom ventilation slot and out of the container. The top end includes an upper surface with apertures to enable fluid to enter the container from above in a manner that allows the fluid to contact substantially all of the contents of the container. These containers are filled and placed upright in the cooling box for hydrocooling.

The invention includes a method for packaging and hydrocooling produce products. The method involves providing a container with produce therein wherein the container has a body with a top and a bottom and a closed lid enclosing the produce. The container having an upper ventilation surface has openings configured to enable a cooling fluid to enter the containers in a manner that allows the fluid to contact substantially all of the produce within the container during a hydrocooling process. Additionally, the container has a bottom surface that enables drainage of excess cooling fluid out of the bottom of the container and wherein the container is arranged with other similar containers in a cooling box capable of holding the containers upright to enable cooling fluid to enter the containers to cool the produce and allow the cooling fluid to drain out of the bottom of the containers and box. The method further including directing the cooling fluid into the top of the box and into the containers through the openings in the upper ventilation surfaces of the containers thereby contacting substantially all of the produce within each container to effectuate hydrocooling of the produce.

These and other aspects of the present invention are described in greater detail in the detailed description of the invention set forth herein below.

BRIEF DESCRIPTION OF THE DRAWINGS

The following detailed description will be more readily understood in conjunction with the accompanying drawings, in which.

Figure 1:
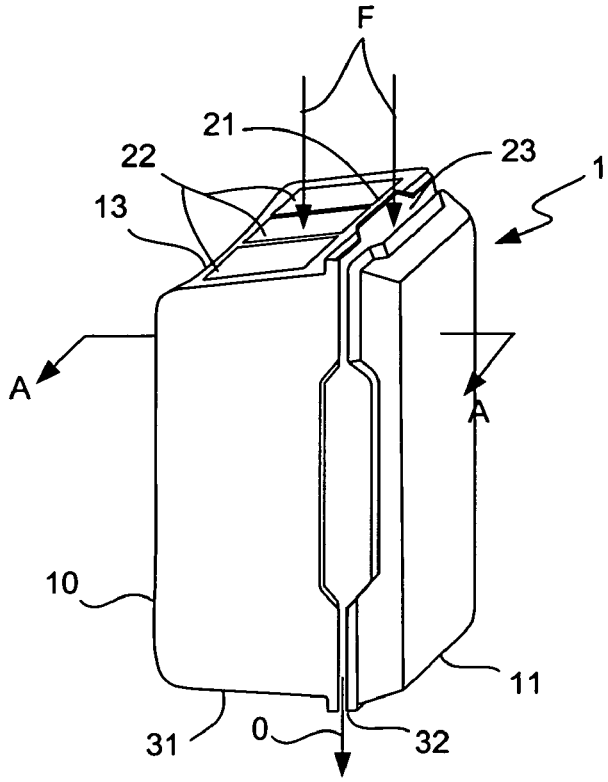
FIG. 1 is a simplified perspective view depicting a closed produce container embodiment according to the principles of the present invention.

It is to be understood that, in the drawings, like reference numerals designate like or similar structural elements. Also, it is understood that the depictions in the Figures are simplified depictions intended to generally convey important aspects of the invention. Accordingly, the Figures do not cover all possible implementation details and applications contemplated by the inventors and moreover are not necessarily drawn to scale.

DETAILED DESCRIPTION OF THE INVENTION

The present invention has been particularly shown and described with respect to certain embodiments and specific features thereof. The embodiments set forth herein below are to be taken as illustrative rather than limiting. It should be readily apparent to those of ordinary skill in the art that various changes and modifications in form and detail may be made without departing from the spirit and scope of the invention.

The present invention includes a produce packaging container that is configured to facilitate efficient hydrocooling of produce products. In particular, the containers can be sized to hold non-bulk quantities of produce. In one important application, the containers can be sized to hold consumer sized batches of produce such as can commonly be purchased at stores. These containers are configured to allow easy and efficient delivery of large quantities of cool water into the container to obtain maximum contact with the surface of the produce inside. This contact of liquid coolant (typically cold water) with the maximum surface area of the produce efficiently cools the produce. Additionally, the produce container is configured to obtain efficient drainage of excess coolant out of the container. This prevents excess coolant from pooling at the bottom of the container to the harmful detriment of the produce inside. These containers can be loaded into a cooling box which also permits high water volume influx through the top and efficient drainage out of the bottom. Such compartmentalization of produce into individually packaged produce containers facilitates ease of unloading and protects the produce much better than existing bulk produce processing system used in current hydrocooling technologies. The following description covers several method and apparatus embodiments for improved hydrocooling technologies in accordance with the principles of the invention.

FIG. 1 depicts a perspective view of a first embodiment of the produce container 1 constructed in accord with the present invention. The depicted container 1 embodiment (although separate body and lid implementations are within the scope of the invention) is a one-piece structure incorporating both basket body 10 and lid 11. That portion of produce container 1 joining basket body 10 and lid 11 is formed as a hinge (not shown in this view). If desired, the basket body 10 can include an arched channel way 13 formed in back side of the basket body 10. In the depicted embodiment, the arched channel way 13 extends longitudinally along the long axis of the basket body 10. This arched channel way 13 can enable a cooling airflow to pass underneath the basket body 10 when the basket is laid on its back side. Alternative embodiments can be constructed without the arched channel way (e.g., with a flat back side) if desired. Additionally, other embodiments can be constructed with more than one arched channel way.

Important features of the present invention are located on the top end 21 of the container 1. The top end 21 includes an upper ventilation surface that includes apertures configured to enable fluid to enter the container in a manner that allows the fluid to flow (depicted by arrows F) to contact substantially all of the surface area of the produce in the container. It is important that there be an ample distribution of apertures in the top surface 21 of the container to enable sufficient distribution of cooling fluid onto substantially all portions of the produce. Some embodiments can use relatively large apertures to enhance the cooling water flow into the container. For example (as depicted in FIG. 1), the top surface 21 can include a plurality of orifices 22 formed in the body 13 of the container 1. Additionally, at least one of the apertures of the upper ventilation surface can include an upper ventilation slot 23 defined by a gap between the lid 11 and body 10 when the container 1 is closed. The container is typically closed using one of many latching mechanisms known to those having ordinary skill in the art. A non-exclusive list of such latches or lid securement methods includes: edge catch latches, button catch latches (a.k.a. "button latches"), snap latches, hook-and-loop closures, shrinkwrap banding, elastic band, and adhesive tape. And also, mated tooth latches can be employed as disclosed in U.S. Pat. Nos. 5,738,890, 6,074,676, and U.S. Pat. Ser. No. 10/017,893, all previously incorporated by reference.

Without adequate drainage, cooling water has a tendency to pool at the bottom of current hydrocooling boxes. As explained above, excess amounts of this water is undesirable. Thus, the depicted embodiment is configured to allow cooling water F to be introduced at the top 21 of the container and includes a bottom surface 31 configured to enhance drainage and enable a substantial portion of the water to drain out of the container. This prevents substantial pooling of water beyond what is necessary to keep certain types of produce moist to prevent the produce from drying out. For example, the bottom end 31 can include a bottom ventilation slot 32 formed in the bottom surface of the container. Accordingly, the cooling fluid O drains out of the container.

Figure 2:
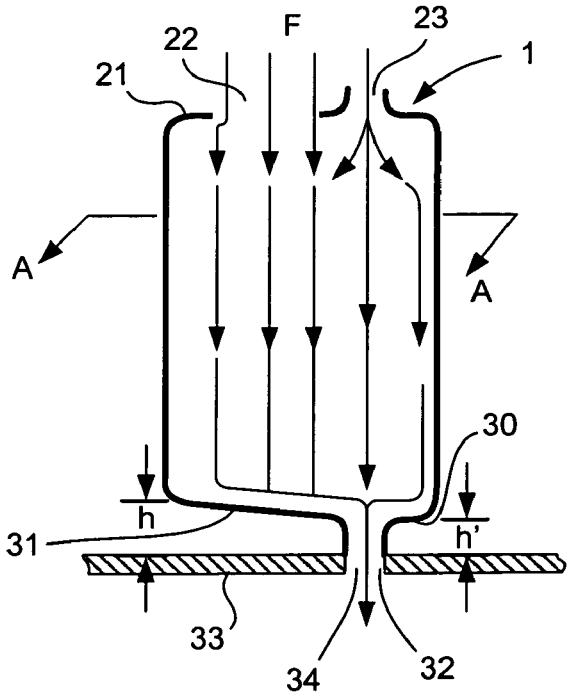
FIG. 2 is a simplified cross-section view of the closed produce container shown in FIG. 1 with a schematic depiction of the water flow also depicted.

The flow of cooling water through the container 1 is also depicted in FIG. 2 which is a cross-section view of FIG. 1. The water flow F into the container 1 is shown passing through apertures 22, 23 into the interior of the container 1. Due to the large number of openings in the top 21 of the container, a good distribution of water flow (depicted by the arrows) through the container is achieved. The inventors further contemplate that a wider spatial distribution of the openings over the top surface 21 can be used enhance the distribution of water flow into the container. In particular, an upper ventilation slot can be formed at the interface between the lid 11 and the body 10 to enable further spatial distribution for the water inflow. Although depicted with three rather large openings 22, the inventors contemplate that there can be a greater or fewer number of openings and a greater or fewer number of openings.

Another advantageous feature of the invention is depicted in FIG. 2. The bottom surface 31 includes a bottom ventilation slot 32 for draining excess moisture out of the container 1. A feature of the depicted embodiment of the invention is that the bottom ventilation slot 32 is at the lowest point in the bottom surface 31 enabling the cooling water to flow out the opening 32. Although the opening can be located anywhere in the bottom of the container it is depicted here as being formed at the interface between the lid 11 and the body 10. In particular, the bottom surfaces of the container are angled downward toward the bottom ventilation slot 32 enabling drainage of fluid toward the bottom ventilation slot and out of container. In some embodiments, the container 1 can be mated with a cooling box 33 that has openings in its bottom enabling water to flow out of the box 33. In particular embodiments, the box 33 includes at least some openings 34 that are sized and spaced to match those of the containers 1 so that when the containers are loaded into the box 33 the container openings 32 are in registry with the box openings 34. This will enable the water to flow directly into the containers, onto the produce, and out through the bottom of the containers and box. In the depicted embodiment, the container 1 is positioned in an upright configuration. The back side of the depicted container is raised above the outflow vent 32 a distance h and the front side of the lid 11 is raised above the outflow vent 32 a distance h'. This enables the water to flow down the sloped bottom surface and out the outflow vent 32.

While these depicted embodiments are vacuum formed plastic structures, the principles of the present invention are equally applicable to alternative materials and manufacturing technologies. In the depicted embodiment, the container 1 is formed of a PET material such as Copolyester 9921, available from Eastman Kodak. Alternative materials include, but are not limited to, various polymeric and monomeric plastics including, but not limited to, styrenes, polyethylenes (including HDPE and LPDE), polyesters, and polyurethanes; metals and foils thereof; waterproofed paper products may also be employed. Alternative manufacturing technologies include, but are again not limited to, thermocasting; casting, including die-casting; thermosetting; extrusion; sintering; lamination; the use of built-up structures as well as many other processes well known to those of ordinary skill in the art.

Figure 3:
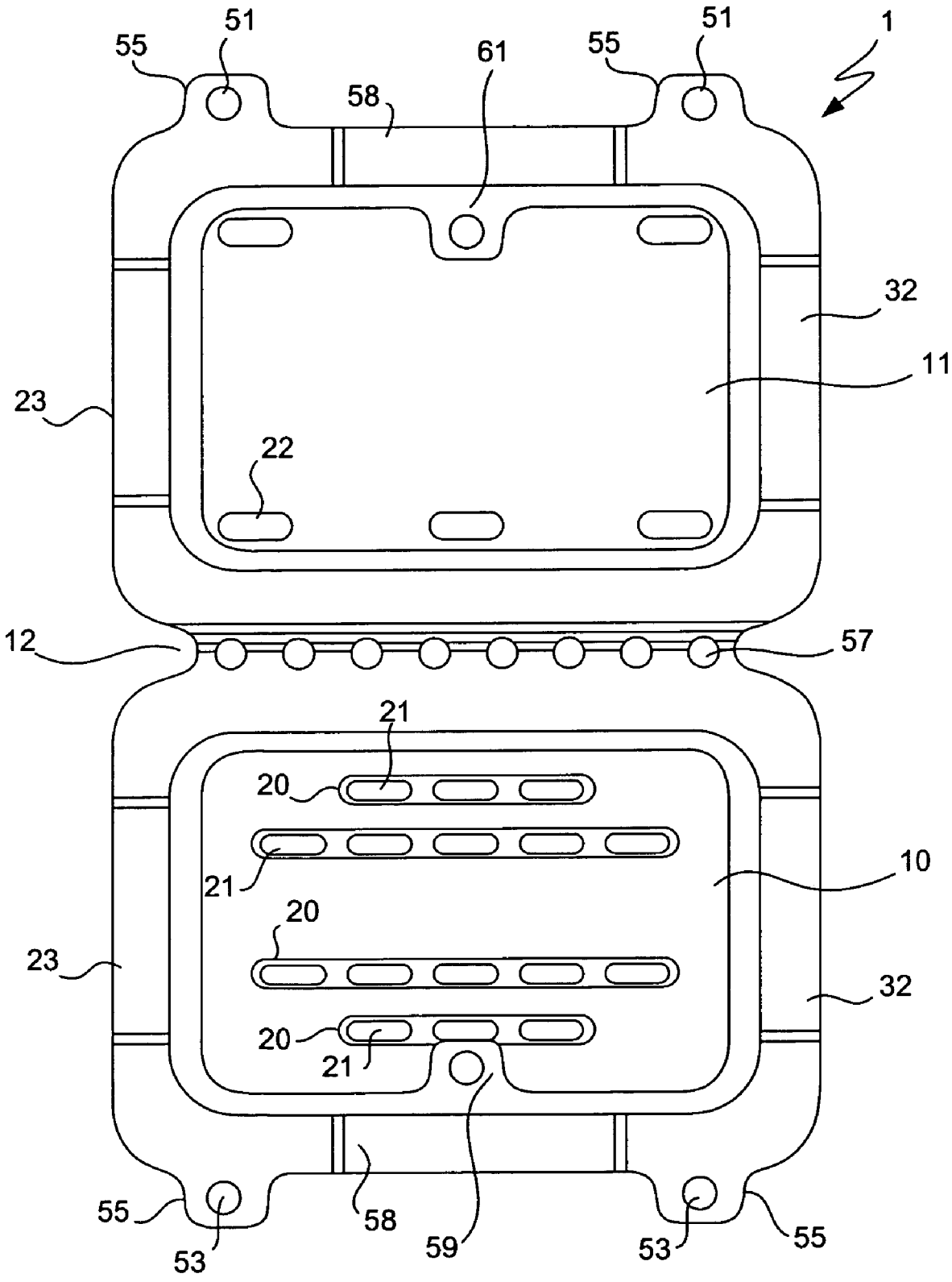
FIG. 3 is a simplified front view of one embodiment of an opened produce container embodiment according to the principles of the present invention.

FIG. 3 is a frontal view of an open container 1 constructed in accordance with the principles of the invention. In the depicted embodiment, the lid 11 is attached to the basket body 10 using a hinge 12 having a plurality of small ventilation apertures 57 formed in the hinge 12. Additionally, the edges of the lid 11 and body 10 define a plurality of ventilation slots (e.g., 23, 32) to facilitate water inflow and outflow. When the lid 11 is closed on the body 10, the depicted edges define upper and lower ventilation slots 23, 32.

Additionally, the present invention specifically contemplates a hinge 12 having a vent. The vent can comprise many apertures 57 (as depicted) or a single aperture. These apertures can take many shapes including, but are specifically not limited to, circles, oblongs, squares, rectangles, polygons, and figures. Examples of the latter may include letters, numerals, and geometric or cartoon shapes.

Button latches are also depicted, the latches for securing the lid 11 to basket body 10. In one embodiment the button catches are defined by pairs 59 and 61 and also latch pairs 51 and 53. In order to provide the requisite compression strength to enable securing this median button catch (defined by 59 and 61), one or both of button catch members 59 and 61 may be advantageously mounted on a pilaster formed in one or both of basket body 10 and basket lid 11.

Also, some embodiments include one or more ventilation openings 21 within vent bosses 20 in order to provide a similarly improved flow of cooling water or air through the container. Additionally, one or more ventilation openings 22 can be provided in the lid 11 to improve ventilation and drainage. Also, in the depicted embodiment, another vent slot 58 can be added between the lid and body enabling ventilation when the lid 11 and body 10 are secured together. In the depicted embodiment, the ventilation features 57, 58 are positioned to enable a cooling flow through the container in a direction transverse to the other set of ventilation slots 23, 32. Such an arrangement enables transverse cooling flow through the container and also improves the cooling performance generally for the container. In some embodiments, it is intended that these transverse airflows be in a direction substantially perpendicular from one another.

Figure 4:
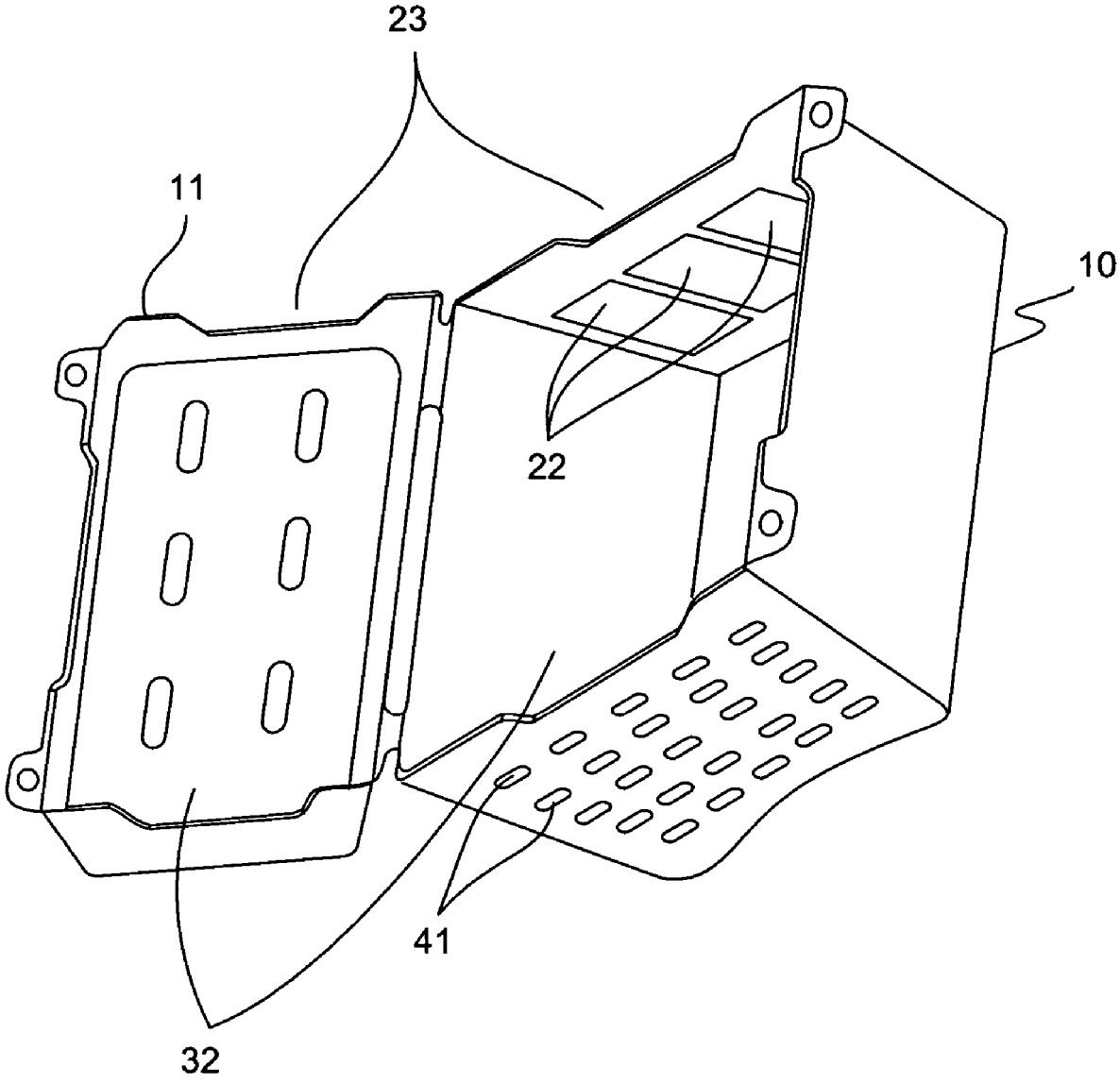
FIG. 4 is a simplified perspective view of another embodiment of an open produce container depicting some ventilation attributes of the invention.
Figure 5A:
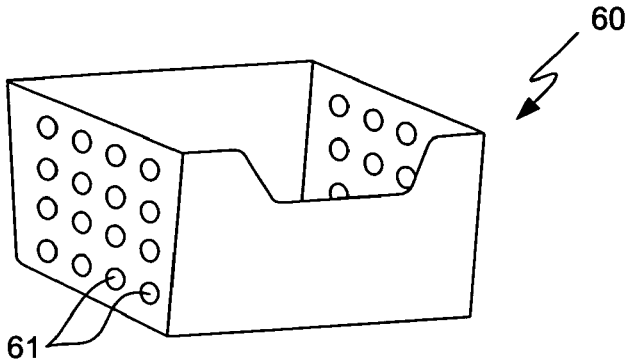
FIGS. 5(*a*)-5(*d*) are various simplified views of embodiments of a cooling box and depictions of the cooling box loaded with produce containers in accordance with the principles of the invention.
Figure 5B:
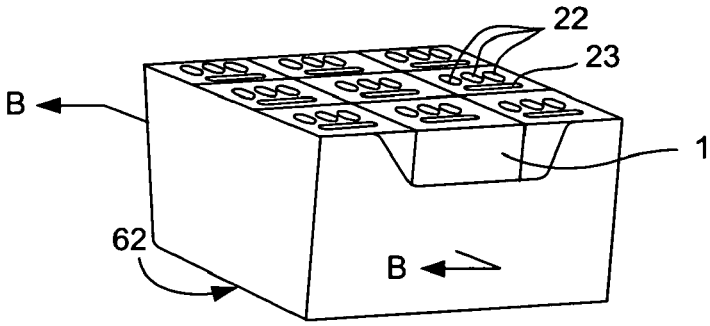
Figure 5C:
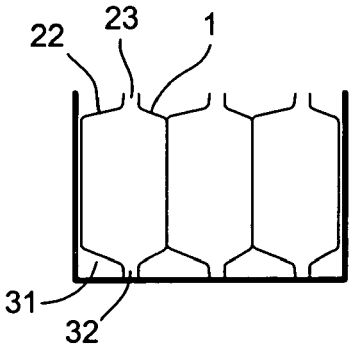
Figure 5D:
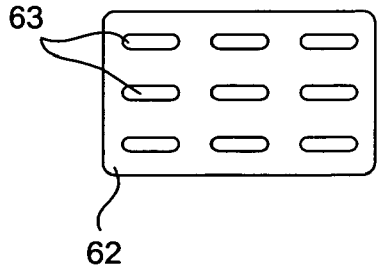

FIG. 4 depicts another container embodiment showing other aspects of the invention. In this perspective view, portions of the bottom surface are shown. In this embodiment, the sloped bottom surface includes a number of openings 41 sized small enough to keep the produce securely inside the container but large enough to facilitate efficient drainage of water out of the container. In some implementations the bottom surface need not be sloped relying instead on the number and distribution of apertures 41 to facilitate effective water drainage. Additionally, the openings 41 can be in addition to a drain slot 32 formed in the container when the lid 11 and body 10 are closed. In this embodiment, a set of upper apertures 22 are formed in the top surface of the container 1. Alternative embodiments can employ a variety of upper aperture 22 sizes, shapes, and orientations. The idea being that the upper apertures facilitate a good distribution of water over all the produce contained in the container. Additionally, this feature can be enhanced by including a top ventilation slot 23 defined by the lid 11 and body 10 when the container is closed.

Referring now to FIGS. 5(*a*)-5(*d*) a cooling box and a method of its implementation with the previously described container to comprise a hydrocooling system are disclosed. FIG. 5(*a*) depicts an embodiment of a cooling box 60. The box is generally constructed with an open top permitting the easy influx of cooling water to cool the contents. The sides generally have openings 61 to allow the water to easily drain away. Typically the boxes are of waterproof construction. In one example, a waxed cardboard box can be used. Although not shown on this view, several apertures are formed in the bottom to drain water out of the boxes. Additionally, the boxes can be provided with lids that protect the contents. In some embodiments, the lids can be vented allowing cooling water to pass through into the inside of the box to cool the contents.

FIG. 5(*b*) depicts the box embodiment 60 loaded with containers 1 in accordance with the principles of the invention. The containers are in upright configuration with ventilation openings 22, 23 facing upward so that water can be showered in through the exposed to surface. The bottom surface 62 includes a plurality of openings (not shown) to enable the box to drain coolant out of the bottom. In the depicted embodiment, the stacking arrangement of the containers 1 maintains them in the upright orientation. Alternative container embodiments can employ supports to hold the containers upright.

FIG. 5(*c*) is a cross-section view of the box embodiment 60 depicted in B-B of FIG. 5(*b*) as loaded with containers 1. The upright containers are depicted with the top ventilation openings 22, 23 facing upward so that water can be showered in through the exposed to surface. Also depicted are a bottom drain vent 32 and a downward sloping container bottom 31. The clearly depicted stacking arrangement maintains the containers 1 in the upright orientation that facilitates drainage of liquid out of the vent 32. Finally, FIG. 5(*d*) depicts the bottom surface 62 of a cooling box 60. Of particular importance are the openings 63 in the bottom of the box. As stated above, they enable drainage from the containers and the box. The inventors also point out that in some embodiments the openings 63 in the box are arranged so that when the containers 1 are loaded into the box the bottom vents 32 of the containers 1 align with the openings in the box. FIG. 2 provides a suitable example.

Figure 6:
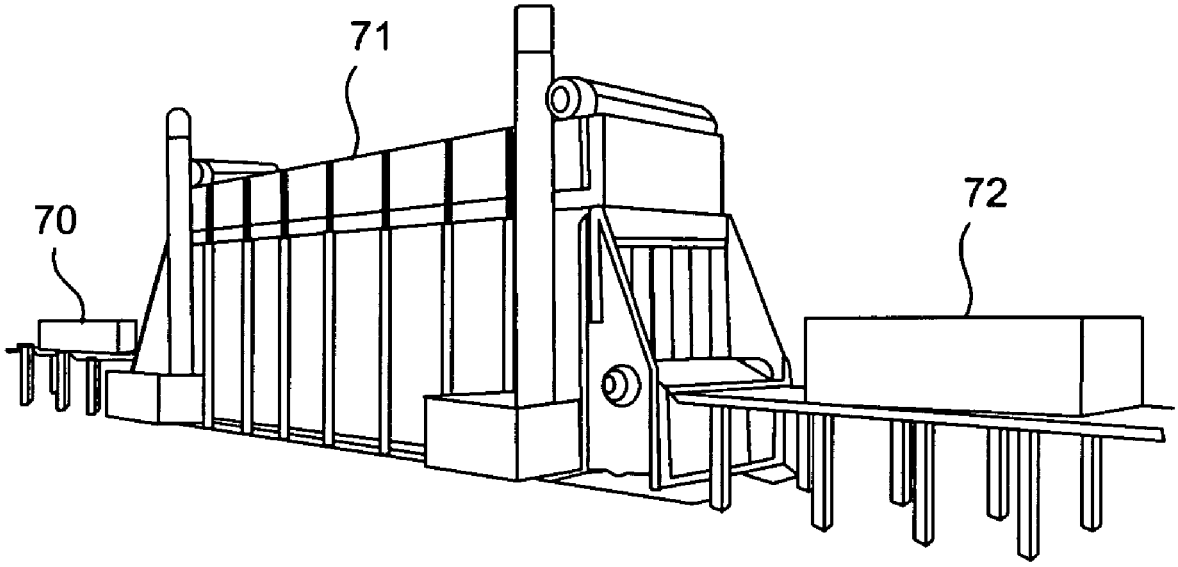
FIG. 6 is a perspective view of a hydrocooling apparatus used to cool the cooling box and produce containers in accordance with the principles of the invention.

FIG. 6 provides a generalized overview of the process employing the previously described system. Generally, produce is placed in the containers which are loaded into the cooling boxes in the field. These loaded cooling boxes 70 are then loaded onto one of many different types of hydrocooling machines 71. The boxes are then doused with temperature controlled water (usually very cold) to cool the produce. The cooled produce boxes 72 are then drained of water and then removed from the machine and placed in a cooled storage or shipping container.

Figure 7A:
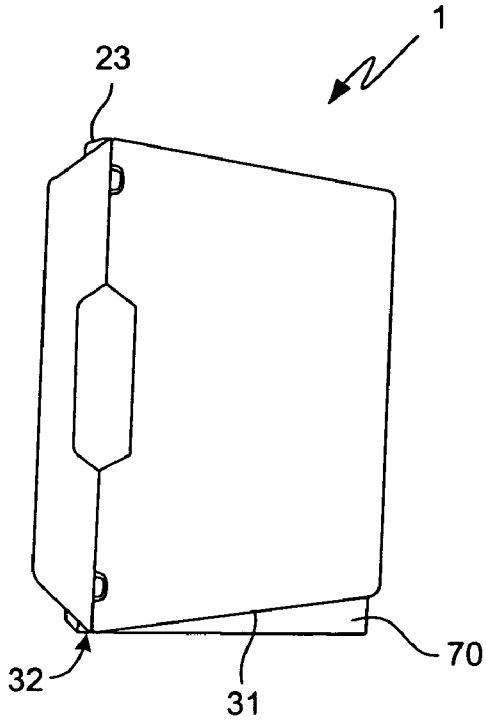
FIGS. 7(*a*) and 7(*b*) are simplified side and front plan views of embodiments of a produce container showing support feet embodiments in accordance with the principles of the invention.
Figure 7B:
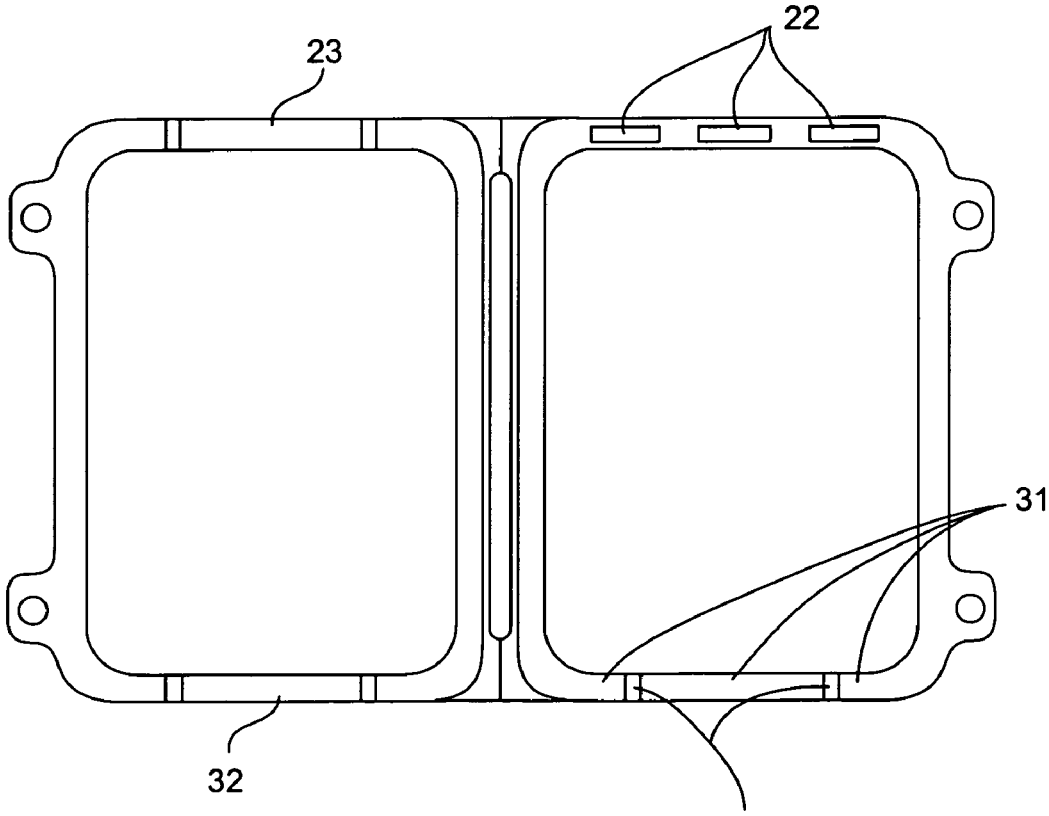

FIGS. 7(*a*) and 7(*b*) are simplified side and front views of an embodiment of a container 1 drawn to illustrate another aspect of the container that can optionally be employed on any or all embodiments of the invention. The embodiment depicted in FIG. 7(*a*) illustrates a side view of a closed container depicting bottom supports 70 (i.e. "feet") for maintaining the container 1 in an upright configuration with a downward slope to the bottom surface 31 to enable draining out of a vent 32. The FIG. 7(*b*) front view of the container, with the lid 11 open, shows the inside of the body 10 with the downward slope of the bottom surface 31 and a pair of supports 70. Also, top apertures 22, 23 are depicted. It should be noted that the inventors contemplate supports 70 having different sizes and shapes depending on the needs of the user.

Figure 8A:
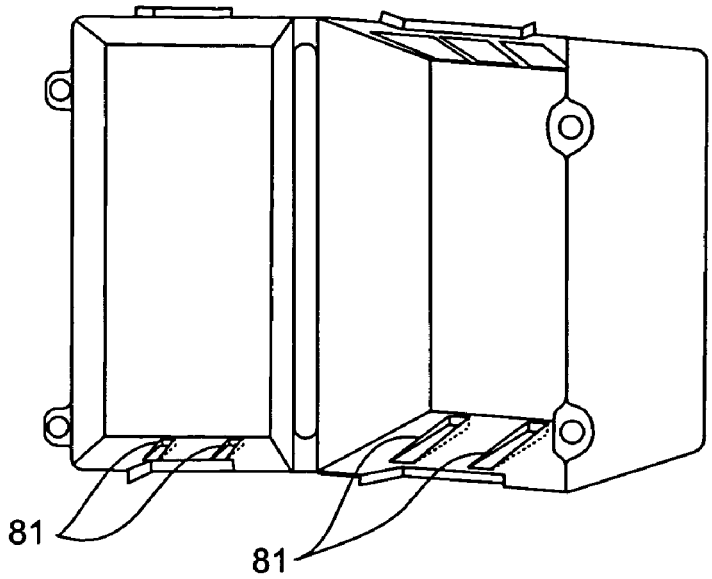
FIGS. 8(*a*) and 8(*b*) are simplified perspective and cross-section views of an embodiment of a produce container showing pad support member and an absorbent pad arranged in accordance with the principles of the invention.
Figure 8B:
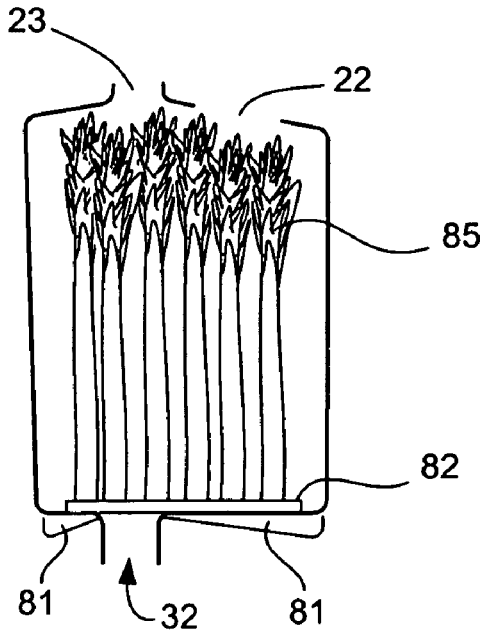

FIGS. 8(*a*) and 8(*b*) are simplified front and cross-section views of another embodiment of a container 1 drawn to illustrate another aspect of the container that can optionally be employed on any or all embodiments of the invention. FIG. 8(*a*) depicts a front perspective view of an open container 1 showing pad supports 81 on both the body and the lid. The pad supports 81 are position to hold a water absorbent pad in place while still allowing the water to drain out of the container. The absorbent pads are of a type known to those having ordinary skill in the art and are commonly used to keep portions of a produce product moist during shipping. For example, the cut ends of an asparagus spear can rest on a wet pad in order not dry out during shipping. However, the container must be configured to allow the pad to perform its function while still draining the excess water out of the container. One implementation of accomplishing this is depicted in the FIGS. 8(*a*) and 8(*b*). This idea is more clearly explained with reference to the cross-section of FIG. 8(*b*) which is depicted with a batch of asparagus 85 inside. The container 1 is upright with an absorbent pad 82 placed on the pad supports 81 and asparagus 85 resting with its cut ends against the pad 85. Water is showered through the upper apertures 22, 23 onto the asparagus 85. The asparagus is cooled and the pad 82 becomes saturated. However, due to the presence of the pad supports 81, the pad 82 is lifted up enough to prevent blockage of water drainage out of the bottom (or other) vents 32. Such an embodiment considerably extends the life of the asparagus. As with all the embodiments described herein, this embodiment finds particular utility when employed with containers sized for consumer sized batches of produce.

Figure 9A:
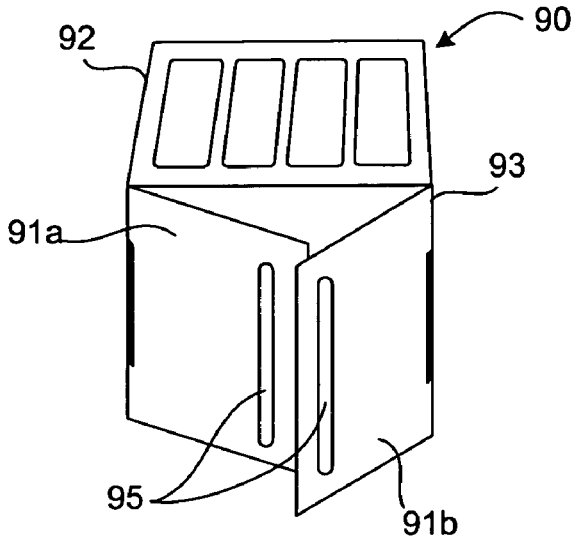
FIGS. 9(*a*)-9(*c*) are various simplified views of other embodiments of a cooling box showing a cooling container with a pair lid flaps in accordance with the principles of the invention.
Figure 9B:
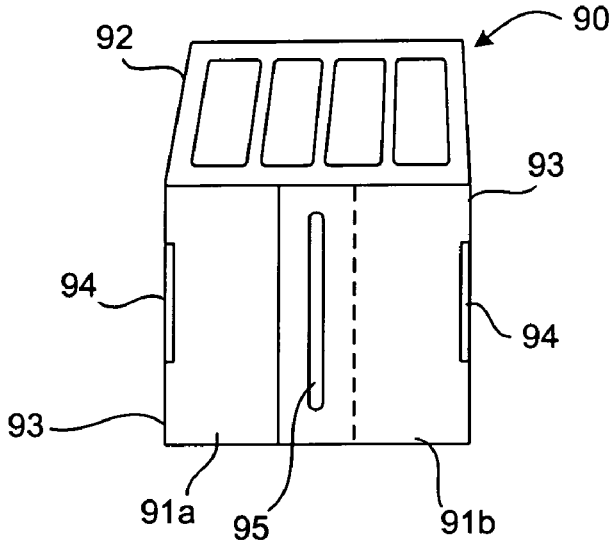
Figure 9C:
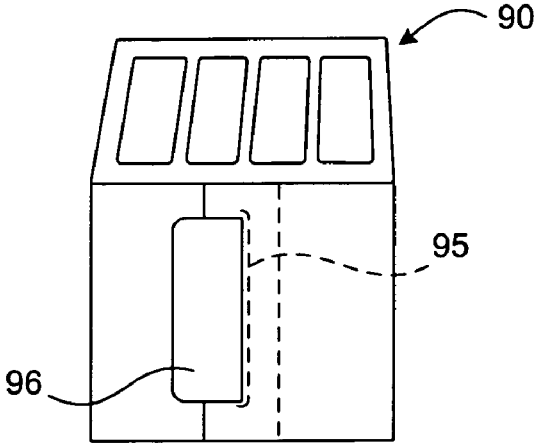

FIGS. 9(*a*) and 9(*b*) show another aspect of the invention. FIG. 9(*a*) depicts a perspective view of an open container 90 constructed in accordance with the principles of the invention. The container is similar to those depicted, for example, in FIGS. 1-5(*c*) and 7(*a*)-8(*b*). Instead on a one-piece lid, the container 90 has a lid comprising a pair of hinged lid flaps 91*a* and 91*b*. The depicted flaps 91*a*, 91*b* are configured so that one flap overlaps the other. However, the inventors contemplate that other implementations configured so that the flaps do not overlap each other are well within the scope of the invention. Such lid flaps can be secured using latches which secure the lids for example to the basket body 92.

In the depicted example, the flaps can be closed. In FIG. 9(*b*) the container 90 is closed. The depicted container 60 has a pair of hinged lid flaps configured so that one lid overlaps the other. In the depicted embodiment, a produce container 90 is constructed as a one-piece structure incorporating both basket body 92 and a dual hinged lid 91*a*, 91*b*. Again, the lid flaps 91*a*, 91*b* are joined to the basket body 92 using hinges 93. In the depicted embodiment, a vent 94 is included in the hinge 93. This vent 94 is of course optional. A top lid 91*b* is depicted overlapping the lower lid 91*a* thereby closing the container 90. The underlying lower lid 91*a* is depicted in part by the dotted line to illustrate where it is covered by the top lid 91*b*. Additionally, the top portions of the lids (91*b*, 91*a*) include a pair of long top latches 95 that extend along the long axis of the container 90. As previously discussed, the top latches 95 can be of many different types and configurations. In the depicted embodiment, the latch 95 runs substantially parallel to the hinges 93 in the overlapping region of the two lids. As indicated previously the latches 95 can interlocks the upper lid 91*b* with the lower lid 91*a* to form a stable latch that can be readily opened or closed as needed. It is noted that in this particular implementation, the latch elements 95 are arranged with their elongate axes extending in a direction parallel to the hinge 93 axis. This not a required configuration, but is merely one possible implementation. Additionally, the inventors contemplate that any shape, orientation, or general configuration can be used for the latches.

As depicted in FIG. 9(*c*), the container 90, once latched can be further sealed using a supplemental fastener 96. The fastener 96 is commonly embodied by an appliqué having an adhesive on one surface. After the container 90 is closed and latched the fastener 96 can be applied as a secondary sealing mechanism to more securely close and secure the container 90 in the closed configuration. Typically, the fastener 96 is affixed to the closed lid flaps 91*b*, 91*a* after the latch 95 is sealed. In the embodiment depicted in FIG. 9(*c*) the fastener 96 covers the upper lid flap 91*b* and extends onto the exposed portion of the lower lid flap 91*a*. Typically, the adhesive of the fastener 96 adheres to both lids. The fastener 63 covers portions of both the upper lid flap 91*b* (depicted in part by the dashed line) and the lower lid flap 91*a*. Also, the fastener 96 can cover the latches 95 (also, depicted here by dashed lines) for a more effective seal. It should be noted that the fastener can be affixed to the container 90 using methods other than adhesive. Heat sealing, photostatic attraction, and other methods of affixing known to those having ordinary skill in the art can be employed. A wide range of materials can also be employed. In certain implementations, a substantially transparent fastener 96 can be employed. Such a fastener is useful in agricultural implementations where it is helpful to be able to inspect produce sealed in a transparent container 90. Additionally, paper or other opaque materials can be used to form the fastener 96.

In a particularly advantageous implementation, the fastener 96 comprises a label. The label can take any form, but is typically used as an appliqué with an adhesive surface for affixing to a container. The fastener 63 can include a logo and/or other labeling information of an infinite variety.

The inventors point out that such fasteners can substantially increase food safety by providing a verifiable seal on each package. The fasteners 96 seal each package and provide a tamper proof seal that maintains the packages in a closed configuration and allows the end user to verify that the package has not been opened along the entire distribution chain. Additionally, the seal provides a customer with safety confidence when buying sealed containers. Additionally, the sealed containers prevent individuals from stealing portions of the contents. Thus, the seals provide a theft deterrent and device for monitoring theft from the containers.

The present invention has been particularly shown and described with respect to certain selected embodiments and features thereof. However, it should be readily apparent to those of ordinary skill in the art that various changes and modifications in form and detail may be made without departing from the spirit and scope of the inventions as set forth in the appended claims. In particular, the arrangement of apertures and drainage features, the number and size of ventilation/drainage apertures, the use of alternative basket forming technologies, tray forming technologies, container and box materials and specifications, container shapes and sizes to conform to differing produce requirements, and vent configurations are all contemplated by the principles of the present invention.

We claim:

1. A produce container comprising:

a unitary plastic container including a top and bottom and at least a first side and an opposed second side, a substantially enclosed basket body having a top opening and a bottom surface, the top opening arranged to receive therein contents to be inserted into the container;

a substantially enclosed lid attached to the basket by a hinge, the lid for covering the basket body when closed and arranged such that when the lid is closed, an opening is formed between the basket and the lid on at least the first and second sides;

a latch for securing the lid to said basket body;

the first side of the basket configured to enable fluid to easily and rapidly enter the container when closed thereby enabling the fluid to enter the container in a manner that allows the fluid to contact substantially all of the contents of the container; and the second side configured so that when the container is placed on a side with the second side facing downward, the inner surfaces of the lid and basket of the downward side each include a slope to facilitate the drainage of a substantial portion of the fluid toward the opening between the lid and basket of the second side thereby enabling fluid drainage out of the container; and wherein a geometry and configuration for fluid inflow apertures of the first side is not symmetric with fluid drainage aperture of the second side.

2. The produce container of claim 1 wherein the second side is configured to prevent substantial pooling of water beyond what is necessary to prevent produce placed in the container from drying out.

3. The produce container of claim 1 wherein at least one of the basket body and the lid are smooth walled.

4. The produce container of claim 1 wherein at least one of the basket body and the lid contain reinforcing ribs.

5. The produce container of claim 1 wherein the latch is a button latch.

6. The produce container of claim 1 wherein the latch is selected from the group consisting of: edge catch, button catch, snap, hook-and-loop closure, shrinkwrap banding, elastic band, and adhesive tape.

7. The produce container of claim 1 wherein the latch comprises a pair of toothed vertically mating latches including a first engageable tooth disposed upon said basket body and a second engageable tooth disposed upon said lid and wherein said teeth engage with each other when the lid is closed.

8. The container of claim 1 wherein the drainage apertures on the second side consist of said openings between the lid and the basket and wherein the fluid inflow apertures of the first side comprise a plurality of vents in the basket.

9. A produce container comprising:

a unitary plastic container including, a substantially enclosed basket body having a bottom end and a top end and a first side and an opposed second side;

a lid connected to the basket body using a hinge and arranged to enable covering of the basket body when the lid is closed and wherein a ventilation opening is formed in the hinge;

a latch for securing the lid to said basket body;

the bottom end configured to enable fluid drainage out of the container; and the top end including an upper ventilation surface that includes apertures configured to enable fluid to enter the container in a manner that allows the fluid to contact substantially all of the contents of the container; and wherein a geometry and configuration for fluid inflow apertures of the first side is not symmetric with fluid drainage aperture of the second side.

10. The produce container of claim 9 wherein another ventilation opening is formed in the container on a side opposing the hinge defining an airflow path between the hinge opening and said another ventilation opening when the container is closed.

11. The produce container of claim 9 wherein a vent is formed by an opening in the hinge thereby enabling a bi-directional airflow through the interior of the container in two substantially perpendicular directions.

12. The produce container of claim 9 wherein the bottom surface of the basket body comprises a first arched surface that forms a first ventilation channel enabling a first cooling flow across the bottom of the container.

13. The produce container of claim 12 wherein the bottom surface further comprises a second arched surface that forms a second ventilation channel arranged to enable a second cooling flow across the bottom of the container in a direction transverse to the first cooling flow.

* * * * *